US010714040B2

(12) United States Patent
Chen

(10) Patent No.: US 10,714,040 B2
(45) Date of Patent: Jul. 14, 2020

(54) DISPLAY DEVICE, DRIVING CIRCUIT AND DRIVING METHOD FOR THE SAME

(71) Applicants: HKC Corporation Limited, Baoan Dist, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 15/740,352

(22) PCT Filed: Aug. 31, 2017

(86) PCT No.: PCT/CN2017/099911
§ 371 (c)(1),
(2) Date: Dec. 28, 2017

(87) PCT Pub. No.: WO2018/205463
PCT Pub. Date: Nov. 15, 2018

(65) Prior Publication Data

US 2020/0058259 A1 Feb. 20, 2020

(30) Foreign Application Priority Data

May 9, 2017 (CN) ..... 2017 1 0327640

(51) Int. Cl.
*G09G 3/36* (2006.01)

(52) U.S. Cl.
CPC ..... *G09G 3/3677* (2013.01)

(58) Field of Classification Search
CPC ..... G09G 3/3677
See application file for complete search history.

(56) References Cited

U.S. PATENT DOCUMENTS

2017/0162147 A1* 6/2017 Kim ..... G09G 3/3607
2018/0061347 A1* 3/2018 Zhang ..... G09G 3/3677

* cited by examiner

*Primary Examiner* — Afroza Chowdhury
(74) *Attorney, Agent, or Firm* — Wang Law Firm, Inc.

(57) ABSTRACT

A display device, the driving circuit and the driving method for the same are provided. Wherein, the input module raises a control end voltage signal Qn to a first high electrical level based on the gate scanning signal Gn−2; the raise module raises the signal Qn from the first high electrical level to a second high electrical level based on the clock signal CLKn−2, the clock signal CLKn−1 and the control end voltage signal Qn−1; the output module couples the control end voltage signal Qn from the second high electrical level to a third high electrical level based on the clock signal CLKn and outputs a gate scanning signal Gn based on the signals Qn and CLKn; the feedback module depresses the coupled control end voltage signal Qn; and the control module controls a depression maintain module to maintain the low voltage of the control end voltage signal Qn.

14 Claims, 6 Drawing Sheets

DISPLAY DEVICE, DRIVING CIRCUIT AND DRIVING METHOD FOR THE SAME

CROSS-REFERENCE TO RELATED APPLICATION

This application claims the benefit of China Patent Application No. 201710327640.7, filed on May 9, 2017, in the State Intellectual Property Office of the People's Republic of China, the disclosure of which is incorporated herein in its entirety by reference.

BACKGROUND OF THE INVENTION

Field of the Invention

The present application relates to the field of display panel techniques, in particular, to a display device and the driving circuit and the driving method for the same.

Description of the Related Art

Recently, liquid crystal display (LCD) is widely used in various industries because of its advantages of clear and accurate image, flat display, thin thickness, light weight, radiationless, low power consumption and low operating voltage. Traditionally, a LCD mainly adopts a gate driving IC when achieving a gate driving. However, since that the gate driving IC requires to be bound with the display panel of the LCD by a connecter, and that a plurality of the gate driving ICs are required in a LCD, the cost and the power consumption of a traditional LCD is high.

In order to solve the above problems, the prior arts mainly achieves by adopting a gate driver on array (GOA) circuit. The GOA circuit is mainly an integration of a gate driving circuit of a LCD panel on a glass substrate by means of exposure development, so that a scan driver of a gate signal line to a panel is formed. In particular, the gate voltage point of the GOA circuit will receive a pre-charge signal when the GOA is applying the scan driver to the gate signal line of the panel. The pre-charge signal pre-charges the gate voltage point so that the voltage of the point achieves a high voltage level in the role of a clock signal. Further, the output transistor is turned on, the signal is successfully transmitted, and the panel gate signal line is further driven. However, although the gate driver IC is omitted in the existing GOA circuits thereby the cost and power consumption is reduced and the integration level is high, the signal transmission is affected when the border of an LCD is narrowed, and further affects the border narrowing of an LCD.

In summary, a GOA circuit of the existing LCD has a problem that it is not conducive to the border narrowing of the LCD.

SUMMARY OF THE INVENTION

Technical Problem

The object of the present application is to provide a display device, a driving circuit and method of the same, which is intended to solve the problem that the existence of the GOA circuit of the existing LCD is not conducive to the border narrowing of the LCD.

Technical Solution

The present application provides a driving circuit for driving a display panel, comprising:

n number of cascaded gate driving units where n is a positive integer greater than 2, wherein the nth gate driving unit comprises:

an input module for receiving a gate scanning signal Gn−2 outputted by the (n−2)th stage gate driving unit and raising a control end voltage signal Qn to a first high electrical level based on the gate scanning signal Gn−2;

a raise module for receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1;

an output module for receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn;

a feedback module for receiving a feedback signal and depressing the coupled control end voltage signal Qn based on the feedback signal; and a control module for controlling a depression maintain module to maintain the low voltage of the control end voltage signal Qn.

Another object of the present application is to provide a display device, comprising:

a backlight module, a display panel and a control device, wherein the backlight module is utilized to provide a light source to the display panel;

the control device comprises a driving circuit;

the driving circuit is to utilized to drive the display panel; and the driving circuit comprises:

n number of cascaded gate driving units where n is a positive integer greater than 2, wherein the nth gate driving unit comprises:

an input module for receiving a gate scanning signal Gn−2 outputted by the (n−2)th stage gate driving unit and raising a control end voltage signal Qn to a first high electrical level based on the gate scanning signal Gn−2;

a raise module for receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1;

an output module for receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn;

a feedback module for receiving a feedback signal and depressing the coupled control end voltage signal Qn based on the feedback signal; and a control module for controlling a depression maintain module to maintain the low voltage of the control end voltage signal Qn.

The yet another object of the present application is to provide a driving method based on the aforementioned driving circuit, comprising:

receiving a gate scanning signal Gn−2 outputted by a (n−2)th stage gate driving unit and raising a control end voltage signal Qn of the output module to a first high electrical level, by the input module;

receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1, by the raise module;

receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn, by the output module;

receiving a feedback signal and depressing the coupled control end voltage signal Qn based on the feedback signal, by the feedback module; and controlling a depression maintain module to maintain the low voltage of the control end voltage signal Qn, by the control module.

Benefit

The present application adopts a driving circuit comprising a input module, an output module, a control module, a depression maintain module, a feedback module and a raise module, so that the input module receives a gate scanning signal Gn−2 outputted by the (n−2)th stage gate driving unit and raises a control end voltage signal Qn to a first high electrical level based on the gate scanning signal Gn−2; the raise module receives a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raises the control end voltage signal Qn from the first high electrical level to a second high electrical level based on the clock signal CLKn−2, the clock signal CLKn−1 and the control end voltage signal Qn−1; the output module receives a clock signal CLKn, coupling the control end voltage signal Qn from the second high electrical level to a third high electrical level based on the clock signal CLKn and outputs a gate scanning signal Gn based on the coupled control end voltage signal Qn and the clock signal CLKn; the feedback module receives a feedback signal and depresses the coupled control end voltage signal Qn based on the feedback signal; and the control module controls a depression maintain module to maintain the low voltage of the control end voltage signal Qn. Hence, the level of the control end voltage signal Qn is raised for three times, which improves the strength of the control end voltage signal Qn and solve the problems of that the existence of the GOA circuit of the existing LCD is not conducive to the border narrowing of the LCD.

DESCRIPTION OF THE PREFERRED EMBODIMENTS

Hereinafter, the present application will be described taken in conjunction with the accompanying drawings and embodiments, for further clearly understanding the objects, technical features and advantages of present application. It is to be understood that particular embodiments described herein are merely for a purpose of explaining the present application and are not for limiting the present application.

Figure 1:
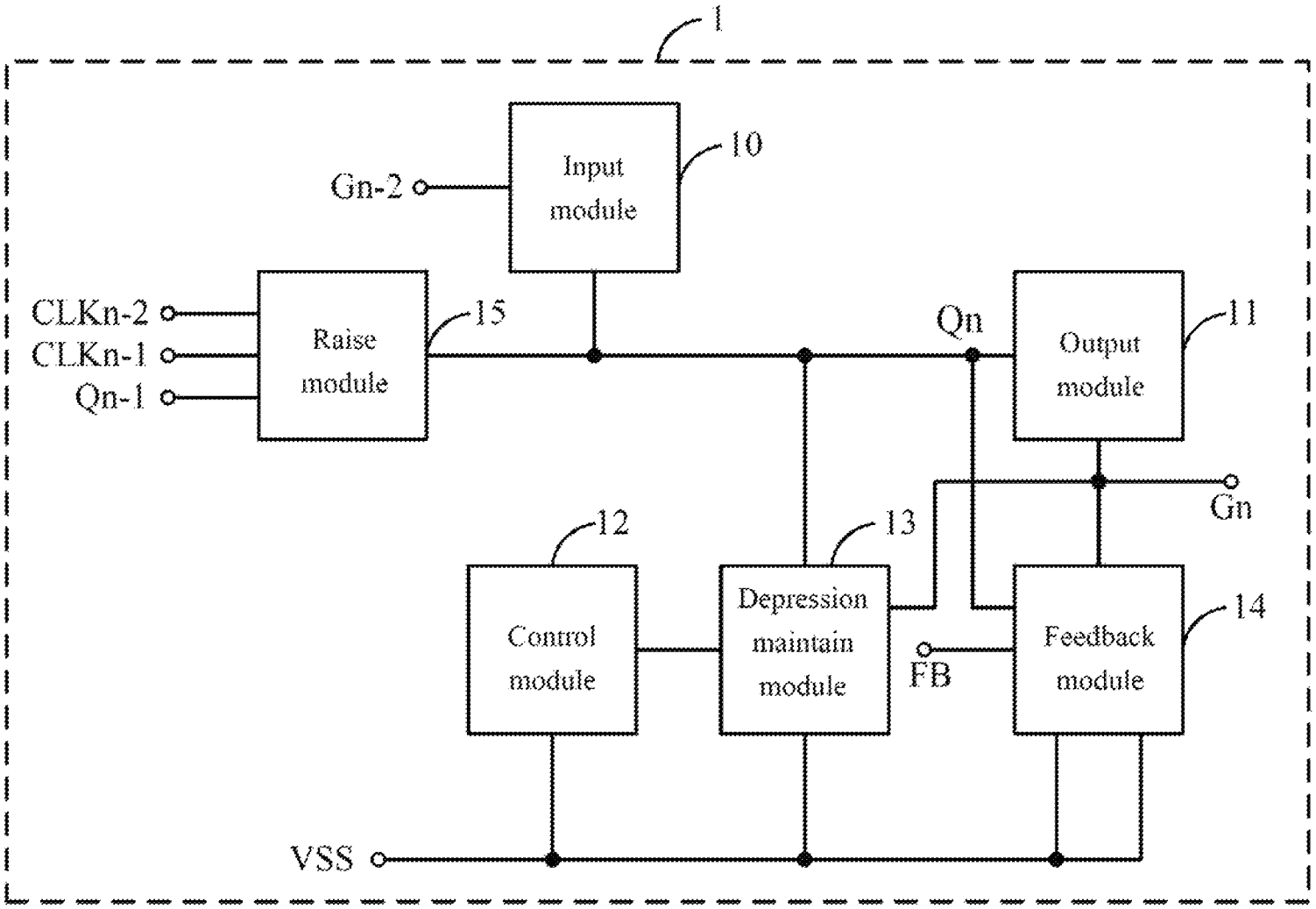
FIG. 1 is a schematic scheme of a module structure of the driving circuit provided in an embodiment of the present application.

The detail description of the implement of the present application will be described taken in conjunction with the accompanying drawings as follows:

FIG. 1 illustrates a module structure of the driving circuit provided in an embodiment of the present application. For ease of describing, only the parts related to the present embodiment are shown. The detail descriptions are as follows:

As shown in FIG. 1, the driving circuit provided in the present embodiment is utilized to drive a display panel, in particular, to drive a gate scanning line utilized to drive the display panel.

Wherein, the driving circuit comprises n number of cascaded gate driving units 1 (one is shown as an example in the drawings) where n is a positive integer greater than 2. The nth gate driving unit 1 comprises an input module 10, an output module 11, a control module 12, a depression maintain module 13, a feedback module 14 and a raise module 15.

In particular, the input module 10 is utilized to receive a gate scanning signal Gn−2 outputted by the (n−2)th stage gate driving unit, and to raise a control end voltage signal Qn to a first high electrical level based on the gate scanning signal Gn−2.

The raise module 15 is utilized to receive a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and to raise the control end voltage signal Qn from the first high electrical level to a second high electrical level based on the clock signal CLKn−2, the clock signal CLKn−1 and the control end voltage signal Qn−1.

The output module 11 is utilized to receive a clock signal CLKn, to couple the control end voltage signal Qn from the second high electrical level to a third high electrical level based on the clock signal CLKn and to output a gate scanning signal Gn based on the coupled control end voltage signal Qn and the clock signal CLKn.

The feedback module 14 is utilized to receive a feedback signal and to depress the coupled control end voltage signal Qn based on the feedback signal.

The control module 12 is utilized to control a depression maintain module 13 to maintain the low voltage of the control end voltage signal Qn.

It has to be explained, in the present embodiments of the application, since the driving circuit provided in the present embodiments of the application is also achieve by utilizing a GOA circuit but the particular circuit structure therein is varied in comparison with the existing GOA circuit, it still has all of advantages of the GOA circuit. Further, each of the structure of the nth gate driving units 1 within the driving circuit are the same, thus which are only described by an embodiment herein. In addition, the control module 12 and the depress maintain module 13 in the present application may be achieved by adopting the existing control circuits and depress maintain circuits, which is merely necessary to ensure that a low electrical level will be maintained after the control end voltage signal Qn is depressed. The structures and working principles thereof will not be described in details here.

Figure 2:
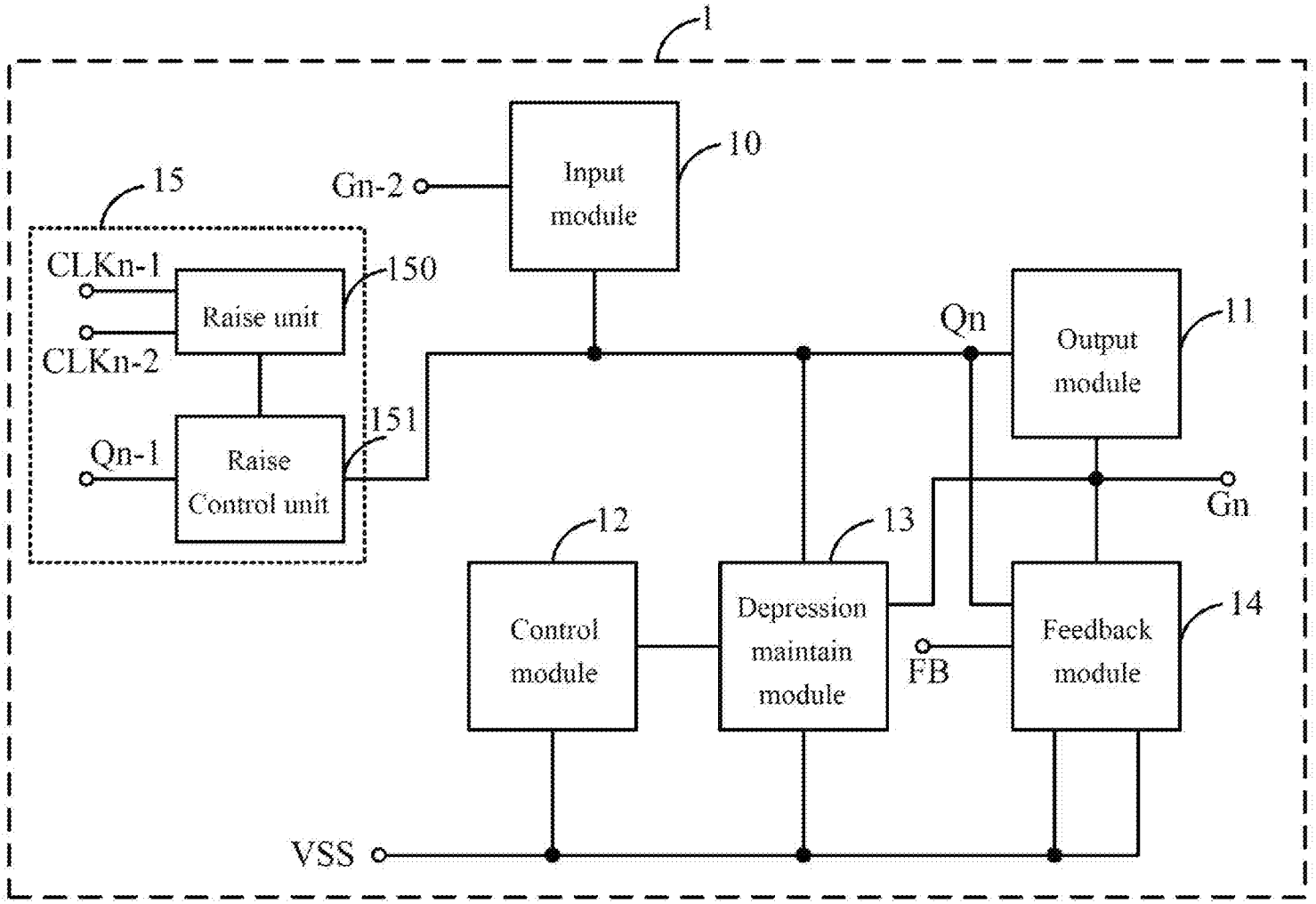
FIG. 2 is a schematic scheme of a module structure of the driving circuit provided in another embodiment of the present application.

In an embodiment, which is considered as an alternative embodiment of the present application, as shown in FIG. 2, the raise module 15 comprises a raise unit 150 and a raise control unit 151.

In particular, the raise unit 150 receives a clock signal CLKn−2 and a clock signal CLKn−1, and generates a first raising signal to the raise control unit 151 based on the clock signal CLKn−2 and the clock signal CLKn−1. The raise control unit receives the control end voltage signal Qn−1, and generates a second raising signal Pun−1 based on the control end voltage signal Qn−1 and the first raising signal so as to raise the control end voltage signal Qn from the first high electrical level to the second high electrical level.

Figure 3:
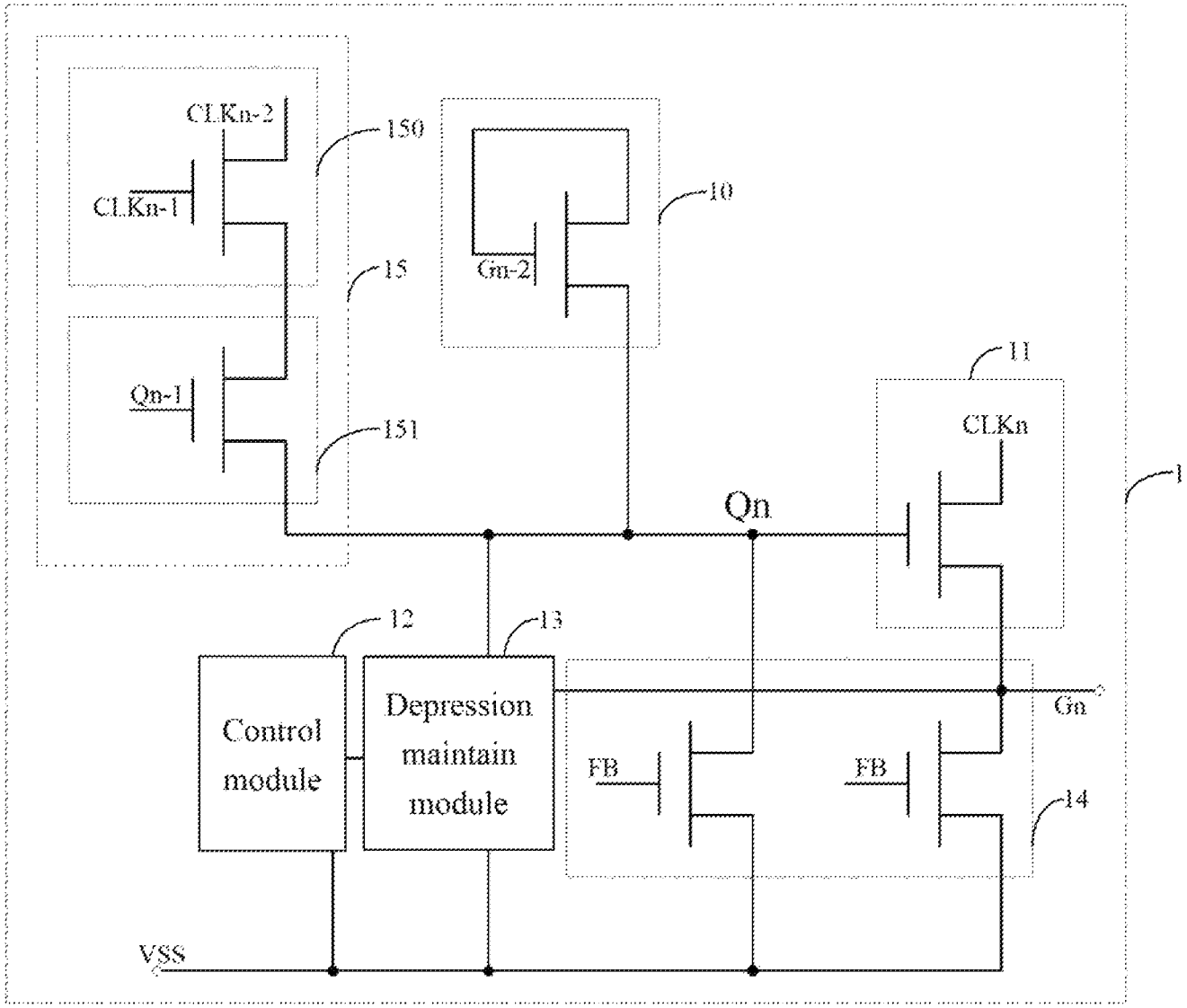
FIG. 3 is a schematic scheme of a circuit structure of the driving circuit provided in an embodiment of the present application.

In an embodiment, which is considered as an alternative embodiment of the present application, as shown in FIG. 3, the raise unit 150 comprises a first switch element Q1. An input end of the first switch element Q1 receives the clock signal CLKn−2, and a control end of the first switch element Q1 receives the clock signal CLKn−1. The first switch element Q1 generates the first raising signal based on the clock signal CLKn−2 and the clock signal CLKn−1. An output end of the first switch element Q1 outputs the first raising signal to the raise control unit 151.

The first switch element Q1 may be achieved by utilizing a NMOS transistor when particularly implemented. The gate electrode, the drain electrode and the source electrode of the NMOS transistor are the control end, the input end and the output end of the first switch element Q1, respectively. It is to be understood that the first switch element Q1 may also be achieved by utilizing a PMOS transistor, which is not limited herein. Whereas, the gate electrode, the drain electrode and the source electrode of a PMOS transistor are the control end, the input end and the output end of the first switch element Q1, respectively, when achieved by utilizing the PMOS transistor.

In an embodiment, which is considered as an alternative embodiment of the present application, as shown in FIG. 3, the raise control unit 151 comprises a second switch element Q2. An input end of the second switch element Q2 receives the first raising signal, and a control end of the second switch element Q2 receives the control end voltage signal Qn−1. The second switch element Q2 generates the second raising signal Pun−1 based on the first raising signal and the control end voltage signal Qn−1.

The second switch element Q2 may be achieved by utilizing a NMOS transistor when particularly implemented. The gate electrode, the drain electrode and the source electrode of the NMOS transistor are the control end, the input end and the output end of the second switch element Q2, respectively. It is to be understood that the second switch element Q2 may also be achieved by utilizing a PMOS transistor, which is not limited herein. Whereas, the gate electrode, the drain electrode and the source electrode of a PMOS transistor are the control end, the input end and the output end of the second switch element Q2, respectively, when achieved by utilizing the PMOS transistor.

In an embodiment, which is considered as an alternative embodiment of the present application, as shown in FIG. 3, the input module 10 comprises a transistor Q3. The control end of the transistor Q3 is commonly connected to the input end, and receives the gate scanning signal Gn−2. The output end of the transistor Q3 is connected to the control end of the output module 11. It has to be explained that the transistor Q3 may be a NMOS transistor in the present embodiments of the application. The gate electrode, the drain electrode and the source electrode of the NMOS transistor are the control end, the input end and the output end of the transistor Q3, respectively. It is to be understood that the transistor Q3 may also be a PMOs transistor, which is not limited herein.

In an embodiment, which is considered as an alternative embodiment of the present application, as shown in FIG. 3, the output module 11 comprises a transistor Q4. The control end of the transistor Q4 is a control end of the output module 11. The input end of transistor Q4 receives a clock signal CLKn. The output end of the transistor Q4 outputs a gate scanning signal Gn. It has to be explained that the transistor Q4 is a NMOS transistor in the present embodiments of the application. The gate electrode, the drain electrode and the source electrode of the NMOS transistor are the control end, the input end and the output end of the transistor Q4, respectively. Is it to be understood that the transistor Q4 may also be a PMOS transistor, which is not limited herein.

In an embodiment, which is considered as an alternative embodiment of the present application, as shown in FIG. 3, the feedback module 14 comprises a transistor Q5 and a transistor Q6.

In particular, the control end of the transistor Q5 and the control end of the transistor Q6 receive a feedback signal FB. The input end of the transistor Q5 is connected to the output end of the transistor Q4. The output ends of the transistor Q5 and the transistor Q6 both receive a low electrical level VSS.

It has to be explained, in the present embodiments of the application, the feedback signal FB may be achieved by utilizing the gate scanning signal Gn−2 outputted by the (n−2)th stage gate driving unit, and may also be achieved by utilizing the gate scanning signal Gn−1 outputted by the (n−1)th stage gate driving unit, which is not limited herein and is merely necessary to ensure the object of depressing the coupled control end voltage signal Qn. In addition, the transistor Q5 and the transistor Q6 are both NMOS transistor. The gate electrode, the drain electrode and the source electrode of the NMOS transistor are the control ends, the input ends and the output ends of the transistor Q5 and the transistor Q6, respectively. It is to be understood that the transistor Q5 and the transistor Q6 may also be a PMOS transistor, which are not limited herein.

Figure 4:
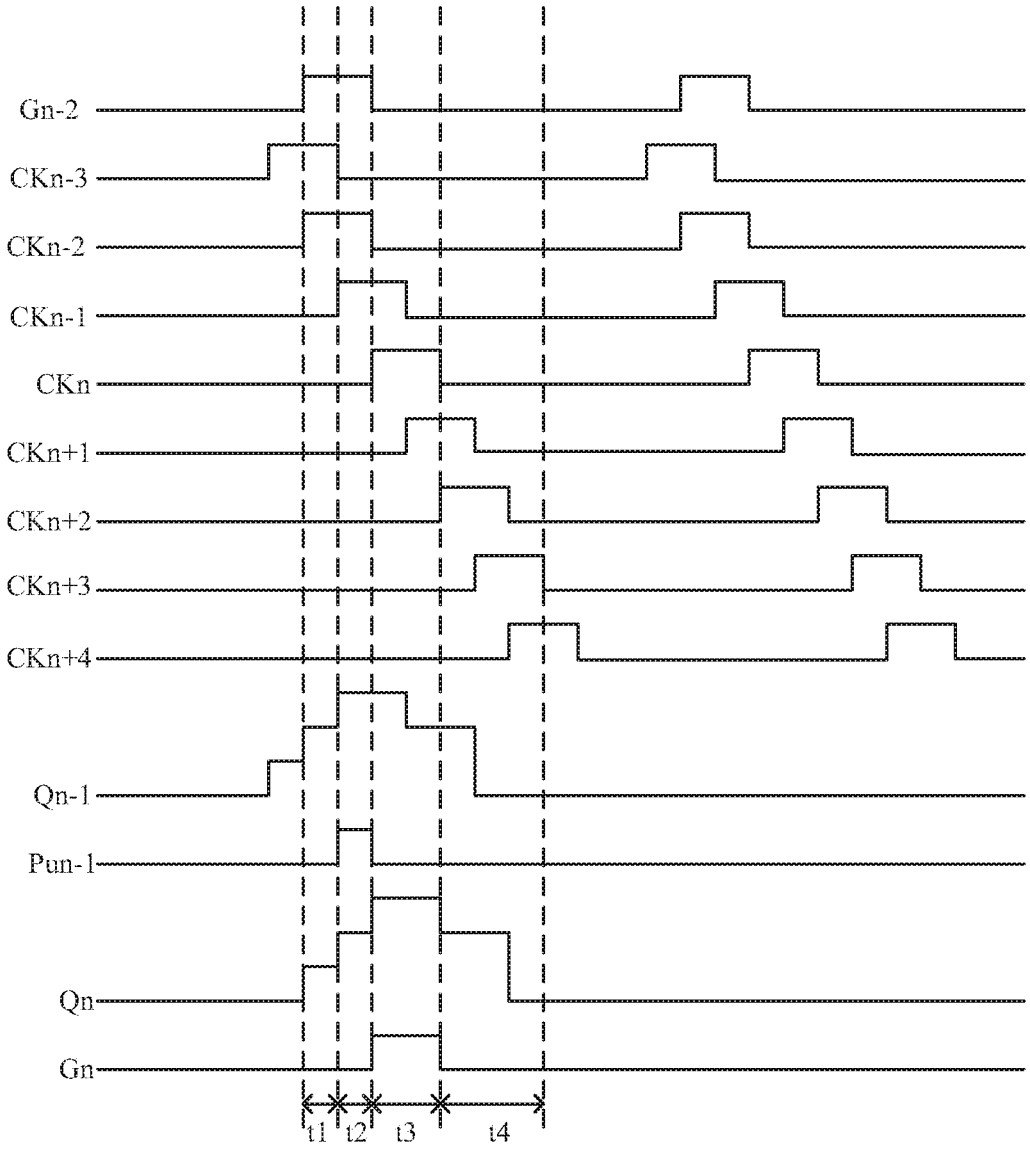
FIG. 4 is a schematic scheme of the working timing of the driving circuit provided in an embodiment of the present application.

The working principle of the driving circuit provided in the present application will be particularly described taken in conjunction with the circuit shown in FIG. 3 and the timing diagram shown in FIG. 4 as examples.

It has to be explained, the period from receiving the gate scanning signal Gn−2 to outputting the gate scanning signal Gn of each of the gate driving units of the driving circuit, that is the t1-t3 shown in FIG. 4, is considered as a scan period, and the remaining is considered as a non-scan period. Further, the scan period are divided into a pre-charge period and an output pulse period, wherein t1 is a first pre-charge time; t2 is a second pre-charge time; and t3 is an output pulse time.

In particular, at the period t1, when the control end and the input end of the transistor Q3 receive the gate scanning signal Gn−2, the transistor Q3 transmits the gate scanning signal Gn−2 with high electrical level to the control end of the transistor Q4, so that the control end voltage Qn of the transistor Q4 is raised to the first high electrical level and achieves a first charge to the control end of the transistor Q4, that is, achieves a first pre-charge to the Q point of the gate driving unit. At the same time, the transistor Q4 is turned on, thereby outputs the clock signal CLKn having a low electrical level to the output end, so that the gate scanning signal is at a low electrical level.

At the period t2, when the control end of the transistor Q1, when the control end of the transistor Q1 receives the clock signal CLKn−1 having a high electrical level, the transistor Q1 is turned on, thereby outputs the clock signal CLKn−2 having a high electrical level received by the input end to the input end of the transistor Q2. That is, the transistor Q1 outputs a first raising signal to the transistor Q2. When the control end of the transistor Q2 receives the control end voltage signal Qn−1 having high electrical level, the transistor Q2 is turned on and transmits the first raising signal having a high electrical level to the control end of the transistor Q4. That is, the transistor Q2 outputs a second raising signal to the transistor Q4, so that the control end voltage Qn of the transistor Q4 is raised from the first high electrical level to a second high electrical level, and achieves a second charge to the control end of the transistor Q4, that is, achieves a second pre-charge to the Q point of the gate driving unit. At the same time, the transistor Q4 is turned on, thereby outputs the clock signal CLKn having a low electrical level to the output end, so that the gate scanning signal is at a low electrical level.

At the period t3, since the control end of the transistor Q4 is at a high electrical level at the period t2, the transistor Q1 is continuously turned on at the same time. When the input end of the transistor Q4 receives the clock signal CLKn having a high electrical level, the transistor Q4 couples the control end voltage Qn from the second high electrical level to a third high electrical level based on the clock signal CLKn having a high electrical level. That is, raising the voltage of the Q point of the gate driving unit. Simultaneously, the transistor Q4 outputs the clock signal CLKn having a high electrical level to the output end, thus the gate scanning signal Gn is at a high electrical level.

It has to be explained, in the present embodiment, the voltage of the Q point is raised from the first electrical level to the second high electrical level and from the second high electrical level to the third high electrical level by the first pre-charge, the second pre-charge and the coupling treatment to the Q point of the gate driving unit. The raising of the wave form of the Q point is achieved, which further improves the signal strength of the Q point, thereby becoming beneficial to the border narrowing of a LCD.

At the period t4, all of the transistors Q1-Q3 are turned off. When the transistor Q5 and the transistor Q6 receive the feedback signal FB (not shown in the drawings) having a high electrical level, the transistor Q6 is turned on based on the feedback signal FB having a high electrical level and depresses the control end voltage signal Qn from the third high electrical level, and the transistor Q4 is cut off. Simultaneously, the transistor Q5 is turned on based on the feedback signal FB having a high electrical level and depresses the scan control signal Gn of the output end from a high electrical level to a low electrical level, thus the scan control signal Qn is at a low electrical level at the time. It has to be explained, in the present embodiment, the depression of the transistor Q6 to the control end voltage signal Qn is divided into two processes which are the same as the prior arts. Hence, they are omitted here.

After the period t4, the control module 12 and the depress maintain module 13 works, and the control module 12 controls the depress maintain module 13 to maintain the low electrical level of the control end voltage signal Qn, so that the transistor Q4 is kept in a cut off status. Hence, the gate scanning signal Gn outputted by the gate scanning unit 1 is kept at a low electrical level after the period t4, thereby prevents from the jumping of the gate scanning signal Gn when the next clock signal CLKn having a high electrical level is coming, which ensures a normal scanning to the gate line of the LCD.

Figure 5:
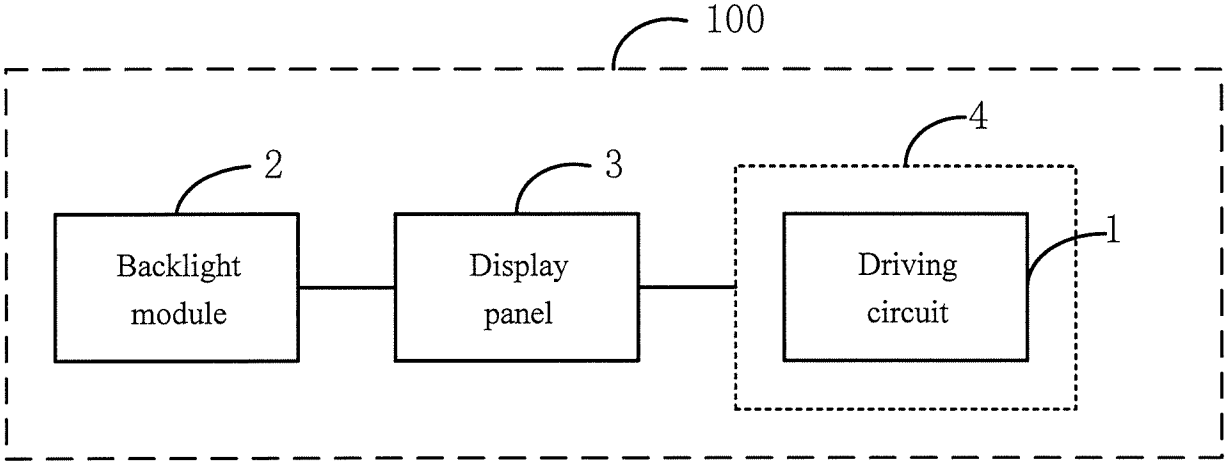
FIG. 5 is a schematic scheme of a module structure of the display device provided in an embodiment of the present application.

FIG. 5 illustrates a display device 100 provided in an embodiment of the present application, the display device 100 comprises: a backlight module 2, a display panel 3 and a control device 4 comprising the aforementioned driving circuit 1; wherein the backlight module 2 is utilized to provide a light source with uniform brightness and distribution to the display panel 3; the control device 4 comprises a driving circuit (not shown in the drawings; please referred to FIG. 1); the driving circuit is utilized to drive the display panel 3; and the driving circuit comprises:

n number of cascaded gate driving units where n is a positive integer greater than 2, wherein the nth gate driving unit comprises:

an input module for receiving a gate scanning signal Gn−2 outputted by the (n−2)th stage gate driving unit and raising a control end voltage signal Qn to a first high electrical level based on the gate scanning signal Gn−2;

a raise module for receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1;

an output module for receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn;

a feedback module for receiving a feedback signal and depressing the coupled control end voltage signal Qn based on the feedback signal; and a control module for controlling a depression maintain module to maintain the low voltage of the control end voltage signal Qn.

It has to be explained, since the driving circuits of the display device 100 provided in the present embodiments of the application are identical to the driving circuits of FIGS. 1 to 4, the particular working principle of the driving circuits within the display device 100 provided in the present embodiments of the application may be referred to the detailed description with respect to FIGS. 1 to 4, and are not to be repeated here.

In addition, the display device 100 provided in the present embodiment of the application may be any type of display device, such as a Liquid Crystal Display (LCD), an Organic Electroluminescence Display (OLED) display device, a Quantum Dot Light Emitting Diodes (QLED) display device, or a curve surface display device.

Figure 6:
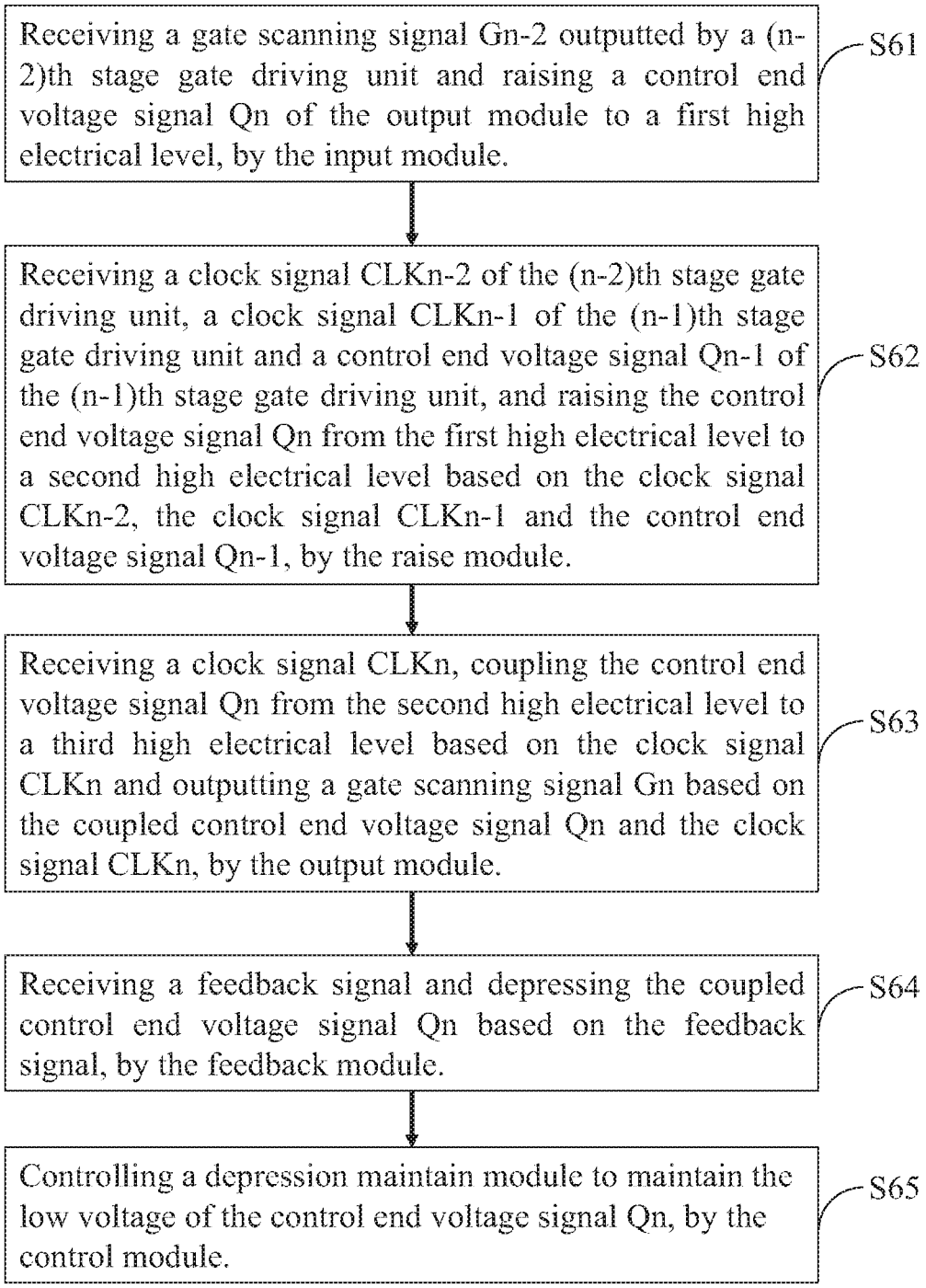
FIG. 6 is a flowing chart of a driving method provided in an embodiment of the present application.

FIG. 6 shows a flowing chart for achieving the driving method provide in an embodiment of the present application. For ease of explaining, only the parts related to the present embodiment are shown, and the detailed description are as follows:

As shown in FIG. 6, the driving method provided in the present embodiment of the application comprises:

S61: receiving a gate scanning signal Gn−2 outputted by a (n−2)th stage gate driving unit and raising a control end voltage signal Qn of the output module to a first high electrical level, by the input module.

S62: receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1, by the raise module.

S63: receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn, by the output module.

S64: receiving a feedback signal and depressing the coupled control end voltage signal Qn based on the feedback signal, by the feedback module.

S65: controlling a depression maintain module to maintain the low voltage of the control end voltage signal Qn, by the control module.

In an embodiment, since the raise module comprises a raise unit and a raise control unit, "receiving a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raising the control end voltage signal Qn from the first high electrical level to a second high electrical level based on the clock signal CLKn−2, the clock signal CLKn−1 and the control end voltage signal Qn−1, by the raise module" is substantially:

receiving the clock signal CLKn−2 and the clock signal CLKn−1 and generating a first raising signal to the raise control unit based on the clock signal CLKn−2 and the clock signal CLKn−1, by the raise unit; and receiving the control end voltage signal Qn−1 and generating a second raising signal based on the control end voltage signal Qn−1 and the first raising signal so as to raise the control end voltage signal Qn from the first high electrical level to the second high electrical level, by the raise control unit.

It has to be explained, the driving method provided in the present embodiment of the application is achieved based on the driving circuit illustrated in FIGS. 1 to 4. Hence, the particular working principles of the driving method provided in the present embodiment of the application may be referred to the descriptions with respect to the driving circuit in FIGS. 1 to 4, and are not to be repeated here.

In the present application, by adopting a driving circuit comprising a input module, an output module, a control module, a depression maintain module, a feedback module and a raise module, the input module receives a gate scanning signal Gn−2 outputted by the (n−2)th stage gate driving unit and raises a control end voltage signal Qn to a first high electrical level based on the gate scanning signal Gn−2; the raise module receives a clock signal CLKn−2 of the (n−2)th stage gate driving unit, a clock signal CLKn−1 of the (n−1)th stage gate driving unit and a control end voltage signal Qn−1 of the (n−1)th stage gate driving unit, and raises the control end voltage signal Qn from the first high electrical level to a second high electrical level based on the clock signal CLKn−2, the clock signal CLKn−1 and the control end voltage signal Qn−1; the output module receives a clock signal CLKn, coupling the control end voltage signal Qn from the second high electrical level to a third high electrical level based on the clock signal CLKn and outputs a gate scanning signal Gn based on the coupled control end voltage signal Qn and the clock signal CLKn; the feedback module receives a feedback signal and depresses the coupled control end voltage signal Qn based on the feedback signal; and the control module controls a depression maintain module to maintain the low voltage of the control end voltage signal Qn. Hence, the level of the control end voltage signal Qn is raised for three times, which improves the strength of the control end voltage signal Qn and solve the problems of that the existence of the GOA circuit of the existing LCD is not conducive to the border narrowing of the LCD.

The aforementioned descriptions are merely preferred embodiments, and the present application is not limited thereto. Any modifications, equivalent replacements and improvements within the spirit and principle of the present application should be contained in the scope of the present application.

What is claimed is:

1. A driving circuit for driving a display panel, comprising:

n number of cascaded gate driving unit circuits where n is a positive integer greater than 2, wherein the nth gate driving unit circuit comprises:

an input module circuit for receiving a gate scanning signal Gn−2 outputted by the (n−2)th stage gate driving unit circuit and raising a control end voltage signal Qn to a first high electrical level based on the gate scanning signal Gn−2;

a raise module circuit for receiving a clock signal CLKn−2 of the (n−2)th stage gate driving unit circuit, a clock signal CLKn−1 of the (n−1)th stage gate driving unit circuit and a control end voltage signal Qn−1 of the (n−1)th stage gate driving unit circuit, and raising the control end voltage signal Qn from the first high electrical level to a second high electrical level based on the clock signal CLKn−2, the clock signal CLKn−1 and the control end voltage signal Qn−1;

an output module circuit for receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn;

a feedback module circuit for receiving a feedback signal and depressing the coupled control end voltage signal Qn based on the feedback signal; and a control module circuit for controlling a depression maintain module circuit to maintain the low voltage of the control end voltage signal Qn.

2. The driving circuit as claimed in claim 1, wherein the raise module circuit comprises:

a raise unit circuit for receiving the clock signal CLKn−2 and the clock signal CLKn−1 and generating a first raising signal to the raise control unit circuit based on the clock signal CLKn−2 and the clock signal CLKn−1; and a raise control unit circuit for receiving the control end voltage signal Qn−1 and generating a second raising signal based on the control end voltage signal Qn−1 and the first raising signal so as to raise the control end voltage signal Qn from the first high electrical level to the second high electrical level.

3. The driving circuit as claimed in claim 2, wherein the raise unit circuit comprises a first switch element;

an input end of the first switch element receives the clock signal CLKn−2, and a control end of the first switch element receives the clock signal CLKn−1;

the first switch element generates the first raising signal based on the clock signal CLKm−2 and the clock signal CLKn−1, and an output end of the first switch element outputs the first raising signal to the raise control unit circuit.

4. The driving circuit as claimed in claim 2, wherein the raise control unit circuit comprises a second switch element;

an input end of the second switch element receives the first raising signal, and a control end of the second switch element receives the control end voltage signal Qn−1; and the second switch element generates the second raising signal based on the first raising signal and the control end voltage signal Qn−1.

5. The driving circuit as claimed in claim 3, wherein the first switch element is a first transistor; and a gate electrode, a drain electrode and a source electrode of the first transistor are the control end, the input end and the output end of the first switch element, respectively.

6. The driving circuit as claimed in claim 4, wherein the second switch element is a second transistor; and a gate electrode and a drain electrode are the control end and the input end of the second switch element, respectively.

7. A display device, comprising:

a backlight module circuit, a display panel and a control device, wherein the backlight module circuit is utilized to provide a light source to the display panel;

the control device comprises a driving circuit;

the driving circuit is utilized to drive the display panel; and the driving circuit comprises:

n number of cascaded gate driving unit circuits where n is a positive integer greater than 2, wherein the nth gate driving unit circuit comprises:

an input module circuit for receiving a gate scanning signal Gn−2 outputted by the (n−2)th stage gate driving unit circuit and raising a control end voltage signal Qn to a first high electrical level based on the gate scanning signal Gn−2;

a raise module circuit for receiving a clock signal CLKn−2 of the (n−2)th stage gate driving unit circuit, a clock signal CLKn−1 of the (n−1)th stage gate driving unit circuit and a control end voltage signal Qn−1 of the (n−1)th stage gate driving unit circuit, and raising the control end voltage signal Qn from the first high electrical level to a second high electrical level based on the clock signal CLKn−2, the clock signal CLKn−1 and the control end voltage signal Qn−1;

an output module circuit for receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn;

a feedback module circuit for receiving a feedback signal and depressing the coupled control end voltage signal Qn based on the feedback signal; and a control module circuit for controlling a depression maintain module circuit to maintain the low voltage of the control end voltage signal Qn.

8. The display device as claimed in claim 7, wherein the raise module circuit comprises:

a raise unit circuit for receiving the clock signal CLKn−2 and the clock signal CLKn−1 and generating a first raising signal to the raise control unit circuit based on the clock signal CLKn−2 and the clock signal CLKn−1; and a raise control unit circuit for receiving the control end voltage signal Qn−1 and generating a second raising signal based on the control end voltage signal Qn−1 and the first raising signal so as to raise the control end voltage signal Qn from the first high electrical level to the second high electrical level.

9. The display device as claimed in claim 8, wherein the raise unit circuit comprises a first switch element;

an input end of the first switch element receives the clock signal CLKn−2, and a control end of the first switch element receives the clock signal CLKn−1;

the first switch element generates the first raising signal based on the clock signal CLKn−2 and the clock signal CLKn−1; and an output end of the first switch element outputs the first raising signal to the raise control unit circuit.

10. The display device as claimed in claim 8, wherein the raise control unit circuit comprises a second switch element;

an input end of the second switch element receives the first raising signal, and a control end of the second switch element receives the control end voltage signal Qn−1; and the second switch element generates the second raising signal based on the first raising signal and the control end voltage signal Qn−1.

11. The display device as claimed in claim 9, wherein the first switch element is a first transistor; and a gate electrode, a drain electrode and a source electrode of the first transistor are the control end, the input end and the output end of the first switch element, respectively.

12. The display device as claimed in claim 10, wherein the second switch element is a second transistor; and a gate electrode and a drain electrode are the control end and the input end of the second switch element, respectively.

13. A driving method based on the driving circuit as claimed in claim 1, comprising:

receiving a gate scanning signal Gn−2 outputted by a (n−2)th stage gate driving unit circuit and raising a control end voltage signal Qn of the output module circuit to a first high electrical level, by the input module circuit;

receiving a clock signal CLKn−2 of the (n−2)th stage gate driving unit circuit, a clock signal CLKn−1 of the (n−1)th stage gate driving unit circuit and a control end voltage signal Qn−1 of the (n−1)th stage gate driving unit circuit, and raising the control end voltage signal Qn from the first high electrical level to a second high electrical level based on the clock signal CLKn−2, the clock signal CLKn−1 and the control end voltage signal Qn−1, by the raise module circuit;

receiving a clock signal CLKn, coupling the control end voltage signal Qn from the second high electrical level to a third high electrical level based on the clock signal CLKn and outputting a gate scanning signal Gn based on the coupled control end voltage signal Qn and the clock signal CLKn, by the output module circuit;

receiving a feedback signal and depressing the coupled control end voltage signal Qn based on the feedback signal, by the feedback module circuit; and controlling a depression maintain module circuit to maintain the low voltage of the control end voltage signal Qn, by the control module circuit.

14. The driving method as claimed in claim 13, wherein the raise module circuit comprises a raise unit circuit and a raise control unit circuit;

receiving a clock signal CLKn−2 of the (n−2)th stage gate driving unit circuit, a clock signal CLKn−1 of the (n−1)th stage gate driving unit circuit and a control end voltage signal Qn−1 of the (n−1)th stage gate driving unit circuit, and raising the control end voltage signal Qn from the first high electrical level to a second high electrical level based on the clock signal CLKn−2, the clock signal CLKn−1 and the control end voltage signal Qn−1, by the raise module circuit is:

receiving the clock signal CLKn−2 and the clock signal CLKn−1 and generating a first raising signal to the raise control unit circuit based on the clock signal CLKn−2 and the clock signal CLKn−1, by the raise unit circuit; and receiving the control end voltage signal Qn−1 and generating a second raising signal based on the control end voltage signal Qn−1 and the first raising signal so as to raise the control end voltage signal Qn from the first high electrical level to the second high electrical level, by the raise control unit circuit.

* * * * *